US010403110B2

(12) United States Patent
Aponte Luis

(10) Patent No.: US 10,403,110 B2
(45) Date of Patent: Sep. 3, 2019

(54) ACCESS CONTROL SYSTEM FOR USE IN RESTRICTED AREAS AND INDUSTRIAL ENVIRONMENTS

(71) Applicant: ONTECH SECURITY SL, Seville, La Rinconada (ES)

(72) Inventor: Juan Aponte Luis, Seville (ES)

(73) Assignee: ONTECH SECUIRTY SL, Seville, La Rinconada (ES)

( * ) Notice: Subject to any disclaimer, the term of this patent is extended or adjusted under 35 U.S.C. 154(b) by 85 days.

(21) Appl. No.: 15/508,838

(22) PCT Filed: Sep. 2, 2015

(86) PCT No.: PCT/ES2015/070643
§ 371 (c)(1),
(2) Date: Jul. 21, 2017

(87) PCT Pub. No.: WO2016/034753
PCT Pub. Date: Mar. 10, 2016

(65) Prior Publication Data

US 2018/0174416 A1 Jun. 21, 2018

(30) Foreign Application Priority Data

Sep. 3, 2014 (ES) ..... 201431283

(51) Int. Cl.
*G08B 13/24* (2006.01)
*G08B 13/26* (2006.01)
*G08B 13/196* (2006.01)

(52) U.S. Cl.
CPC ..... *G08B 13/2491* (2013.01); *G08B 13/2417* (2013.01); *G08B 13/2468* (2013.01); *G08B 13/26* (2013.01); *G08B 13/19602* (2013.01)

(58) Field of Classification Search
CPC ..... G08B 13/2491; G08B 13/26; G08B 13/2468; G08B 13/2417; G08B 13/19602
See application file for complete search history.

(56) References Cited

U.S. PATENT DOCUMENTS 8,742,925 B2 6/2014 Vacher et al.
2003/0107484 A1* 6/2003 Gagnon ..... G08B 13/19632 340/552

(Continued)

FOREIGN PATENT DOCUMENTS

JP 2010157045 A 7/2010
WO WO 2014/184024 A1 11/2014
WO WO 2015/044487 A1 4/2015

OTHER PUBLICATIONS

International Search Report issued in Internation Application No. PCT/ES2015/070643 dated Dec. 12, 2015.

(Continued)

*Primary Examiner* — Leon Flores
(74) *Attorney, Agent, or Firm* — Arent Fox LLP

(57) ABSTRACT

The invention relates to an access control system for use in restricted areas (400, 500, 600, 700, 800, 900) and industrial environments comprising at least one controlled electrostatic field sensor (100) connected to at least one antenna (1); wherein said antenna (1) is configured as a single electrode, such that said sensor (100) measures the disturbances in the electrostatic field around said antenna (1) in a particular direction, and wherein the controlled electrostatic field sensor (100) is configured for detecting a disturbance in the electrostatic field generated by its own antenna (1). The sensor (100) is connected to a control device (40, 50, 60, 70, 80, 90).

15 Claims, 6 Drawing Sheets

(56) References Cited

U.S. PATENT DOCUMENTS

| | | | |
|---|---|---|---|
| 2005/0285737 | A1 | 12/2005 | Kobayashi |
| 2009/0256706 | A1 | 10/2009 | Brown |
| 2010/0148961 | A1 | 6/2010 | Raphaeli |
| 2011/0006897 | A1 | 1/2011 | Micko |
| 2012/0313782 | A1 | 12/2012 | Mohamadi et al. |

OTHER PUBLICATIONS

Written Opinion issued in International Application No. PCT/ES2015/07064 dated Dec. 18, 2015.

* cited by examiner

ACCESS CONTROL SYSTEM FOR USE IN RESTRICTED AREAS AND INDUSTRIAL ENVIRONMENTS

CROSS-REFERENCE TO RELATED APPLICATION

This application is a 35 U.S.C. 371 National Phase of PCT Application No. PCT/ES2015/070643 filed Sep. 2, 2015 which claims priority to ES Application No. P201431283 filed Sep. 3, 2014. The disclosure of these prior applications are hereby incorporated by reference herein.

TECHNICAL FIELD

The present invention relates to an access control system. The invention has a practical application in the safety/security sector, and more specifically in safety/security in public or private open spaces, as well as occupational safety and hygiene. The main purpose of the present invention is to control access to prohibited areas by way of a virtual fence which, in another embodiment, also allows detecting crossing points in restricted-access areas, such as platforms, maritime docks or land loading docks, or else to detect an unauthorized access to a restricted safety/security area, such as for example the radius of action of a robot in industrial facilities.

PRIOR ART

Different passive alarm systems are used today in the field of security in open spaces, whether they are public or private, when any type of intrusion is detected. The following are included among the most well-known detection systems:

a) Volume sensors detecting changes in the volume of the area of measurement which are then translated into motion detection.
b) Infrared barrier sensors detecting the passage of an object between their emitters and receivers.
c) Ultrasonic detection sensors.

Compared to these detectors, patent document WO2015/044487 describes an electrostatic field sensor and a security system in indoor spaces that is capable of measuring electrostatic fields and their variations along a metal conductor acting as an antenna or sensing probe. This probe is connected to an electronic circuit capable of decoding said changes in the electrostatic field around the metal conductor of the antenna.

This system allows measuring disturbance by means of a single antenna, and accordingly inferring the presence of a person, distinguishing said person from an animal or thing by measuring the disturbance itself in a single antenna. This system is designed as a preventive proximity alarm detector. It does not describe a system for detecting crossing points in restricted areas or a virtual fence in certain restricted areas, for which purpose it would be necessary to modify the system described in patent document WO2015/044487.

In addition, patent document U.S. Pat. No. 8,742,925 describes a device for detecting and preventing the falling of an object or of a person on a line of a railway station, and more specifically, a platform. This device includes a detector having at least one emitter and one receiver, a falling object/person detector connected to the receiver and controlling the signaling of the tracks and physical barriers arranged along the platform and demarcating a door where the detection device is located. A similar system is described in JP2010157045. Compared to these documents, the present invention considerably simplifies the detection and control of accidents in railway platforms, resulting in a more cost-effective and sustainable system.

The use of virtual fences is known, for example, through patent document US2009256706, which describes a system involving the use of a plurality of devices generating a beam at a given frequency and amplitude, such that an enclosure is formed between the different devices for protecting a given space. The use of radio frequency tags (US2010148961), IR sensors (US2011006897) or V-band emitters/receivers (US2012313782), in addition to radar-type wireless signals of another type (WO2014184024), is also known. Compared to these documents, the present invention considerably simplifies the detection and control of access to a restricted area, which results in a more cost-effective and sustainable system than those that have been described.

Generally none of the described patent documents allows combining the structure of a crossing point or access detector with the use of an electrostatic sensor detecting disturbances in the electrostatic field by means of a single antenna, configured as an electrode arranged such that it considerably simplifies the detection structure, allowing greater certainty and reliability in the control of accesses to restricted areas, including the detection of accidents or the identification of the access in a more precise and less expensive manner.

DISCLOSURE OF THE INVENTION

The system object of the invention integrates a sensor capable of measuring electrostatic fields and their variations in order to determine human presence in a surrounding area close to said probe and distinguishing it from any other animal or object. The invention is based in the capacity that the sensor object of the invention has for measuring variations in the electrostatic field existing around a conductor acting like an antenna, when said field is affected by the influence of a body, the electrostatic field changes, the sensitivity of the sensor being enough to detect said change caused by a person or another object.

Like any other existing object, the human body has its own electrical characteristics dependent on materials, density, volume, temperature and conductivity. The differences in potential between the different objects mean that there are electrostatic discharges from one object to another when them come into contact with one another or are very close to one another. This effect is utilized by the sensor object of the invention, which continuously measures the fluctuations caused by said field in an electronic circuit connected to it. Through the changes in magnitude of the field, this circuit is capable of distinguishing different types of bodies or objects and discriminating human presence from another material or animal presence.

By taking the capacity measurement continuously, the sensor object of the invention indeed shapes the electromagnetic and electrostatic field generated in the antenna and through infinite field lines, a processor connected to same allows determining the volume and density of matter generating the fluctuation in the field in the antenna.

The invention is applied to safety/security systems in industrial facilities, where the operator will be notified of the risk entailed in getting closer to a given restricted or unauthorized area. This, for example, in the area of activity of a robot arm allows said arm to be still when an operator is in its radius of action, regardless of whether the actual operator is later held accountable if said operator was not authorized to that end, for which purpose the system also identifies the operator.

Another object of the present invention relates to an access control system for use in restricted areas that is more precise and easier to implement than the systems described in the prior art, so it is implemented by means of measuring disturbances produced in an electrostatic field due to human presence in the vicinity thereof. This access control system will be made up of at least one virtual fence or a crossing point detector in sensitive or restricted areas, such as railway platforms or loading and/or port docks.

The virtual fence or the crossing point detector comprises at least one electrostatic sensor capable of measuring disturbances generated by people, objects or animals around an antenna which, in turn, emits an electrostatic field and detects disturbances produced in the emitted field. This antenna, generally an electrode, emits the electrostatic field in a directed manner, i.e., it can emit into a portion of the surrounding space and not in an omnidirectional manner, shielding the unwanted part. This is why the arrangement of this antenna is different in each application because each antenna is autonomous for detecting a disturbance in the electrostatic field generated around same, even though they are connected to a single circuit. As a result of the arrangement of the antenna or antennas, it will be possible to define a physical space enclosed by the emitted field, depending on the physical structure in which it is implemented (corridor, dock, platform or the like), without any limitation and in a very simple manner.

These advantages are achieved with the different aspects described in the independent claims and incorporated herein by reference. Other particular embodiments of the invention are described in the dependent claims and are also incorporated herein by reference.

As a result of the system described in said attached claims, an access control system for use in both public and private restricted areas, for industrial use or for any other use is obtained. In a first aspect, this system is configured as a crossing point detector for use in restricted areas due to their danger, such as railway platforms, merchandise loading docks or maritime docks, simplifying security tasks in the operation thereof, and it can be readily integrated both in the physical space and in the surveillance environment currently used in said facilities, such that it can even allow greater automation of the processes carried out in said facilities. In a second aspect, the system is configured as a virtual fence which enables identifying users in a much less expensive and much simpler and more effective manner than in systems known in the prior art.

Throughout the description and claims, the word "comprises" and its variants do not seek to exclude other technical features, additions, components or steps. For the persons skilled in the art, other objects, advantages and features of the invention will be inferred in part from description and in part from putting the invention into practice. The following examples and drawings are provided by way of illustration and do not seek to limit the present invention. Furthermore, the present invention covers all the possible combinations of particular and preferred embodiments mentioned herein.

BRIEF DESCRIPTION OF THE DRAWINGS

A series of drawings that help to better understand the invention and are expressly related to an embodiment of said invention presented as a non-limiting example thereof is very briefly described below.

DETAILED DISCLOSURE OF THE INVENTION

An object of the invention relates to an access control system for use in restricted areas comprising different practical embodiments, such as control in industrial spaces, a virtual fence or a crossing point detector. Each of the particular embodiments of the parts making up the system object of the invention is described in detail below.

First Embodiment of the Electrostatic Field Sensor (100*a*)

Figure 1:
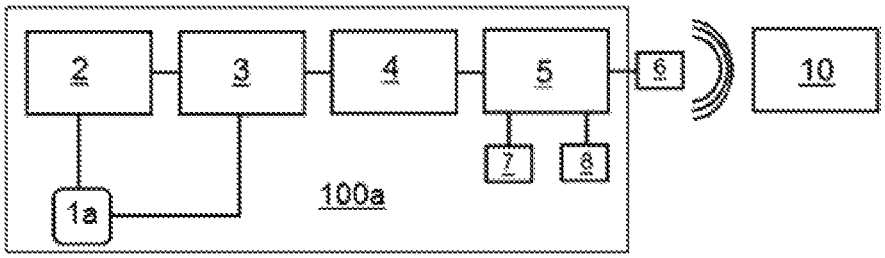
FIG. 1 shows a block diagram of a first embodiment of the sensor of the invention.

As seen in FIG. 1, in a first embodiment the electrostatic field sensor (100*a*) for industrial environments comprises an antenna (1*a*) consisting of a single measuring electrode. The electrostatic field sensor of FIG. 1 is a solution based on the sensor described in WO2015/044487, but improved for implementation in other practical applications.

The antenna (1*a*) is directly connected to a field generating circuit (2) and to a field controlling circuit (3) which is in turn connected to a signal processing circuit (4), essentially an analog-digital converter, which is in turn connected to a processor (5) configured for detecting variations in the electrostatic field, establishing a type of three-dimensional map with said variations, the volume and density of the object that generated said variation being able to be determined. This processor (5) is in turn connected to a radio frequency communication circuit (6) which emits an encrypted signal to a central control unit (10) which controls the entire facility. Furthermore, the processor (5) is connected to a security camera (7) recording the object the processor (5) has detected and defined as an unauthorized intrusion. Finally, the processor (5) is connected to user identification means (8), preferably through Bluetooth®, in order to allow authorized users to access the site and not generate an alarm signal.

Second Embodiment of the Electrostatic Field Sensor (100*b*)

Figure 2:
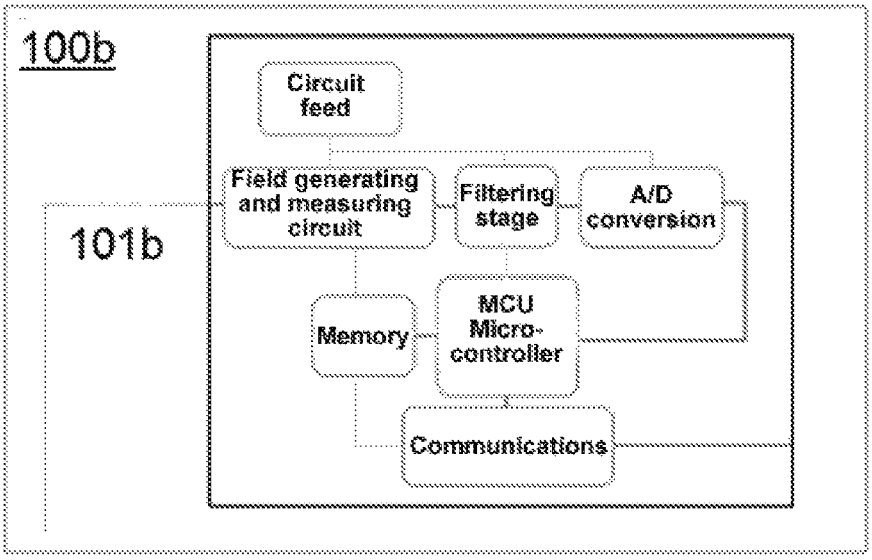
FIG. 2 shows a block diagram of a second embodiment of the sensor of the invention.

FIG. 2 shows an alternative solution of the sensor, describing an alternative embodiment for said sensor. As seen in said FIG. 1, the electrostatic field sensor comprises an antenna (1*b*) consisting of a single electrode that is emitter and receiver (emitting-receiving electrode) at the same time, and it is the antenna (1*b*) used in each and every one the embodiments proposed in the present invention, albeit with different physical configurations and connection capabilities that allow improving the functionality thereof. It must be borne in mind that several antennas can coexist in parallel in some embodiments, even through each of them maintains the particularity of being an emitting antenna and a receiving antenna at the same time.

Nevertheless, the controlled electrostatic field sensor also comprises a field generating and measuring circuit, preferably a tuning circuit having a working frequency less than 5 MHz, comprising an RLC circuit and a phase stabilizing circuit. The signal received in the antenna, after the measurement, passes through a filtering stage, and said signal then goes to an analog-digital converter, which is in turn connected to a processor configured for detecting variations in the electrostatic field, establishing a type of three-dimensional map with said variations, the volume and density of the object that generated said variation being able to be determined. This processor is in turn connected to a radio frequency circuit that emits an encrypted signal to a central control unit or integrated external surveillance system, which controls the entire facility as will be seen in each embodiment. The circuit is completed with a data storage memory.

It should also be indicated that both embodiments of the electrostatic field sensor (100*a*, 100*b*) are not exclusive to one another, i.e., the first embodiment of the sensor (100*a*) or the second embodiment of the sensor (100*b*) can be used, as occurs with the antenna (1*a*, 1*b*) it actually refers to the same physical element, i.e., an electrode configured as an antenna. Given their interchangeability, and to facilitate references to the drawings, the electrostatic field sensor (100*a*, 100*b*) will be referenced as a sensor (100), whereas the antenna (1*a*, 1*b*) in both embodiments will be referenced as an antenna (1).

Application in Industrial Environments

Figure 3:
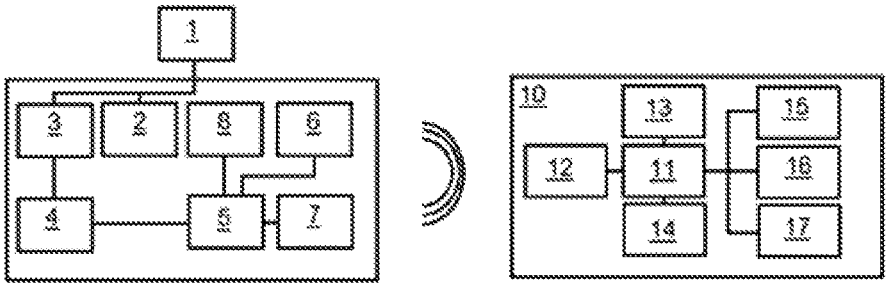
FIG. 3 shows a schematic of the system of the invention for use in industrial environments.

FIG. 3 shows both the block diagram of the sensor (100) per se described in FIG. 1, and of the central control unit (10) in charge of alarm management, likewise comprising a processor (11) connected to a radio frequency communications module (12) connected to at least one sensor device (100) through its respective radio frequency circuit (6). The central control unit (10) is completed with other communications modules, such as Ethernet (13), WIFI (14) or Zigbee (15), further having a capacitive keyboard (16) and a display (17) to make use by operators easier.

It should be indicated that the field generated by the antenna (1) can be directed, that is, depending on the shielding, it is possible to aim the field lines at the desired point of interest, increasing versatility of the invention compared to known alarm systems.

This system can be used, for example, for controlling the area of movement of an industrial robot, numerical control machines or any other machine for industrial use requiring a restricted-access area for safety/security reasons.

In this particular embodiment, the object of the central control unit (10) is to simply record the alarms, because the signals are processed by each sensor independently.

Railway Platform (400)

Figure 4:
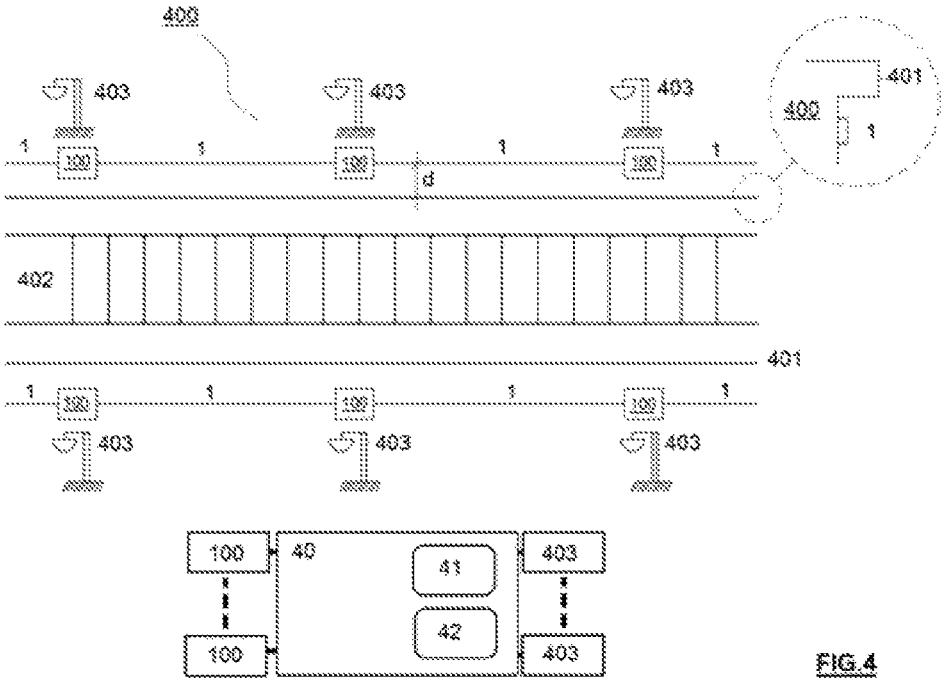
FIG. 4 shows a schematic of the system of the invention integrated in a railway platform.

As can be seen in FIG. 4, for a railway platform (400) the antenna (1) can have two basic positions:

a) Arranged longitudinally a distance (d) from the edge (401) of the platform (400).

b) In a position immediately below the edge (401) of the platform (400).

Position (a) allows controlling the access of people to the entry of the train, whereas position (b) allows detecting any object that has fallen onto the train tracks. All this is done in a simple manner given that in position (a) the antenna (1) will be simply attached to the ground because it is configured as a metal strip connected to a sensor (100), whereas in position (b) the antenna (1) formed by a metal electrode will be integrated in a channel, anticorrosion pipe, protected against humidity and rodents, or any other type of additional protection.

The antennas (1) will be shielded such that the electrostatic field generated in option (a) is perpendicular to the ground, whereas the electrostatic field in option (b) is generated substantially parallel to the ground. Therefore, the generated field can be directed depending on the area to be surveilled.

In an additional embodiment, the train track (402) itself can be configured as an electrode or antenna (1) for detecting people, animals or objects on the track.

There is generally no limit to the number of sensors (100) that can be used for access control systems for use in areas in a railway platform (400). Each of the sensors (3) can control a particular area of the platform (400) because the length of the antenna (1) is preferably equal to or less than ten meters. Therefore, it would be advisable to install a sensor (100) connected to at least one antenna (1) every ten meters for controlling a given area of the platform (400).

In any case, all the sensors (100) are connected to a control device (40) comprising: one or more processors (41); a memory (42); and one or more programs; wherein the program or programs are stored in the memory (42) and configured for being run by means of at least the processor or processors (41), the programs including instructions for: (i) characterizing a disturbance detected by at least one sensor (100); (ii) focusing at least one camera (403) on the area of action of at least one sensor (100) with a detected disturbance; (iii) monitoring the area of action of a sensor (100) with a detected disturbance; (iv) generating a control signal and (v) communicating with the railway management system.

In fact, in a first step at least one sensor (100) will detect a disturbance caused, for example, by a person passing through the area (a). In this case, for example, the railway management system will notify the control device (40) of the presence or absence of a train on the platform (400). If there is no train, then the disturbance will be characterized as a "person in a risk area", the actual camera (403) of the area of the sensor will focus on and monitor said area.

Monitoring can be manual (an operator in a control center) or automatic by means of an automatic image recognition system in which the activity of the person who generated the disturbance is monitored and a control signal consistent with same can be generated, said signal being, for example, the automatic reproduction of a generic message of the type "we remind you that it is forbidden to approach the edge of the platform" in the most innocent case up to blocking, should it be required, the passage of trains to the station if, for example, what is detected is a crowd of people or a situation involving the risk of a fall or a fall onto the train tracks themselves.

A very efficient access control system for controlling access to the railway platform (400) is thereby achieved as it allows characterizing the object, person or people generating the disturbance at a very low cost and without modifying current facilities. The described system allows, for example, operations ranging from controlling the platform in a completely individualized manner, detecting the passage or falling of a single person, to the control of crowds, allowing the railway management system to make decisions in a quick and efficient manner with respect to the known prior art.

Maritime Dock (500)

Figure 5:
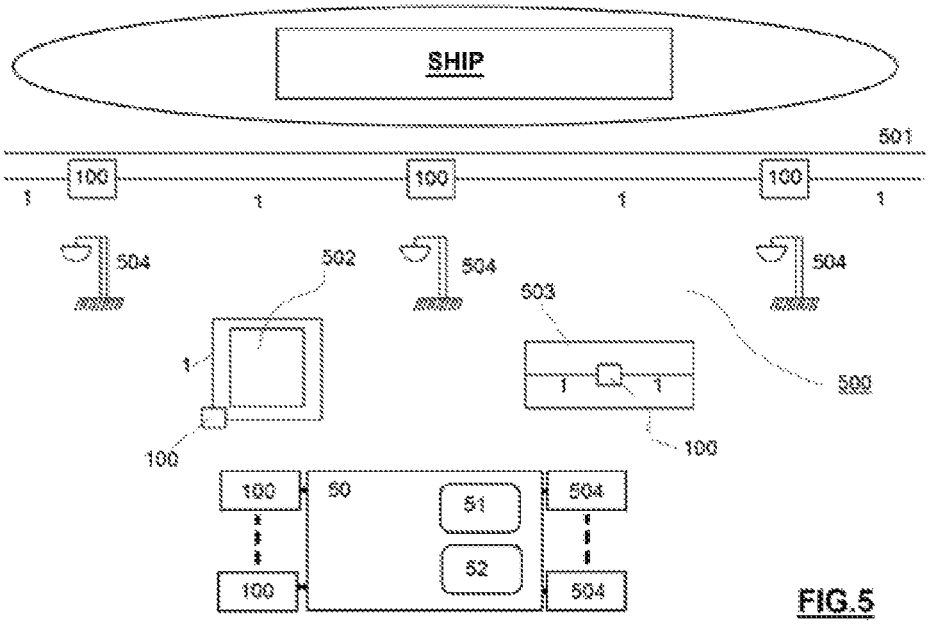
FIG. 5 shows a schematic of the system of the invention integrated in a maritime dock.

In another particular embodiment, the access control system is applicable to maritime loading docks (500) and is particularly useful in container loading docks. As can be observed in FIG. 5, for a maritime dock (500) the antenna (1*b*) can have two basic positions:

a) Arranged longitudinally along the edge (501) of the maritime dock (500).

b) In a position close to the area of activity of a loading crane (502).

Position (a) allows controlling the falling of people or objects into the water, whereas the position (b) allows detecting any object or person that poses an obstacle in the movement of the loading crane (502). All this is done in a simple manner because in both positions (a) and (b), the antenna (1) will simply be attached to the ground because it is configured as a metal strip connected to a sensor (100). The antennas (1) will be shielded such that the electrostatic field is aimed at a predetermined detection area, generally perpendicular to the ground.

In an additional embodiment, the containers (503) used in the port can each have their own sensor (100) with its own antenna (1). So when the sensor (100) is provided with wireless communication means, this solution allows the container to be controlled not only by means of the system, but it also allows complete pre-loading traceability of said container during its journey in the ship itself and unloading at its destination, provided that there is a connection with a compatible control device (100) in all areas.

There is generally no limit to the number of sensors (100) that can be used for access control systems for use in maritime docks (500). Each of the sensors (100) can control a particular area of the maritime dock (500) because the length of the antenna (1) is preferably equal to or less than ten meters. Therefore, it would be advisable to install a sensor (100) connected to at least one antenna (1) every ten meters for controlling a given area of the maritime dock (500).

In any case, all the sensors (100) are connected to a control device (50) comprising: one or more processors (51), a memory (52), and one or more programs; wherein the program or programs are stored in the memory (52) and configured for being run by means of at least the processor or processors (51); wherein the programs include instructions for: (i) characterizing a disturbance detected by at least one sensor (100); (ii) focusing at least one camera (504) on the area of action of at least one sensor (100) with a detected disturbance; (iii) monitoring the area of action of a sensor (100) with a detected disturbance; (iv) generating a control signal and (v) communicating with the port management system.

In fact, in a first step at least one sensor (100) will detect a disturbance caused, for example, a person in the area (b) passing under the crane (502). In this case, for example, the port management system will notify the device (100) of whether or not the crane (502) is in movement, or if said movement is expected soon, or if the load is a risk load. If there is no risk for the person, then the disturbance will be characterized as a "person in restricted area, low-risk", the actual camera (504) of the area of the sensor will focus on and monitor said area.

Monitoring can be manual (an operator in a control center) or automatic by means of an automatic image recognition system in which the activity of the person who generated the disturbance is monitored and a control signal consistent with same can be generated, said signal being, for example, the automatic reproduction of a generic message of the type "we remind you that it is forbidden to approach the crane" in the most innocent case up to blocking, should it be required, the movement of the crane or the loading of containers if, for example, what is detected is a risk for the people or a situation of accumulation or falling of containers or another anomalous situation.

A very efficient access control system for controlling access to a maritime dock (500) is thereby achieved as it allows characterizing the object, person or people generating the disturbance at a very low cost and without modifying current facilities. The described system allows, for example, operations ranging from controlling the maritime dock (500) in a completely individualized manner, detecting the access of a single person, to the control and traceability of containers, providing the loading management system with an improvement in making decisions in a quick and efficient manner compared to the known prior art, which enables a higher degree of automation in the facility.

Loading Bay (600)

Figure 6:
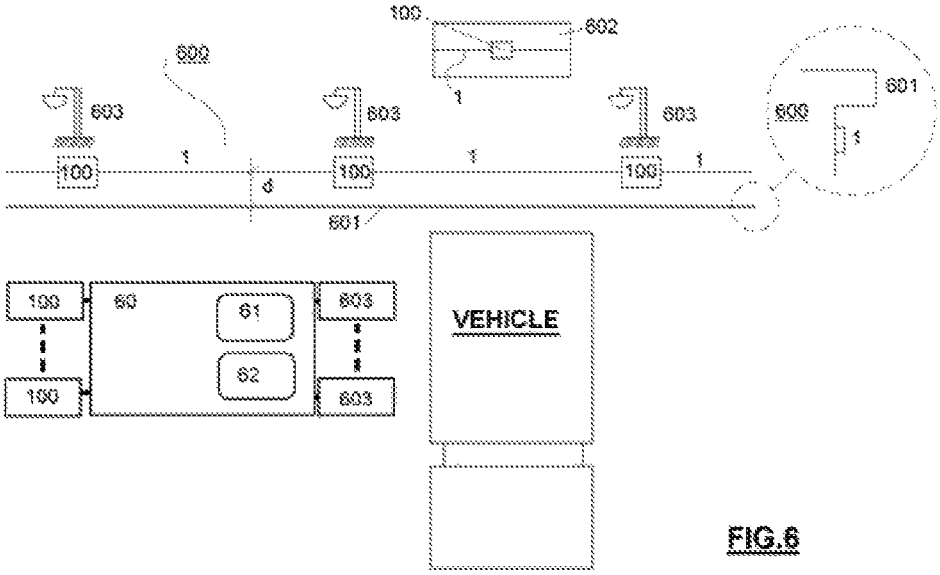
FIG. 6 shows a schematic of the system of the invention for use in a loading bay.

In another particular embodiment, the access control system is applicable to merchandise loading bays (600) and is particularly useful in load automation. As can be observed in FIG. 6, for a loading bay (600) the antenna (1) can have two basic positions:

a) Arranged longitudinally a distance (d) from the edge (601) of the loading bay (600).

b) In a position immediately below the edge (601) of the loading bay (600).

Position (a) allows controlling access to the loading area or region, whereas position (b) allows detecting any object or person falling from the bay (600). All this is done in a simple manner because in both positions (a) and (b), the antenna (1) will simply be attached to the ground because it is configured as a metal strip connected to a sensor (100). The antennas (1) will be shielded such that the electrostatic field is aimed at a predetermined detection area, generally perpendicular to the ground.

In an additional embodiment, the merchandise (602) can each have its own sensor (100) with its own antenna (1). So when the sensor (100) is provided with wireless communication means, this solution allows the merchandise to be controlled not only by means of the system, but it also allows complete pre-loading traceability of said merchandise during its journey and unloading at its destination, provided that there is a connection with a compatible device (100) in all areas.

There is generally no limit to the number of sensors (100) that can be used for access control systems for use in loading bays (600). Each of the sensors (100) can control a bay (600), is sufficient for controlling a bay because they rarely exceed ten meters in length, which is the maximum distance of each antenna (1) for each sensor (100).

In any case, all the sensors (100) are connected to a control device (60) comprising: one or more processors (61), a memory (62), and one or more programs; wherein the program or programs are stored in the memory (62) and configured for being run by means of at least the processor or processors (61); wherein the programs include instructions for: (i) characterizing a disturbance detected by at least one sensor (100); (ii) focusing at least one camera (603) on the area of action of at least one sensor (100) with a detected disturbance; (iii) monitoring the area of action of a sensor (100) with a detected disturbance; (iv) generating a control signal and (v) communicating with the automatic loading management system.

In fact, in a first step at least one sensor (100) will detect a disturbance caused, for example, by a person passing through the loading area (a). In this case, for example, the automatic loading management system will notify the device (100) of if there is in fact an ongoing loading operation taking place, and therefore if there is merchandise (602) in movement, or if said movement is expected soon, or if the load is a risk load. If there is no risk for the person, then the disturbance will be characterized as "person in restricted area, low-risk", the actual camera (603) of the area of the sensor (100) will focus on and monitor said area.

Monitoring can be manual (an operator in a control center) or automatic by means of an automatic image recognition system in which the activity of the person or object that generated the disturbance is monitored and a control signal consistent with same can be generated, said signal being, for example, the automatic reproduction of a generic message of the type "we remind you that it is forbidden to approach the bay" in the most innocent case up to blocking, should it be required, the movement of the load if, for example, what is detected is a risk for the people or a situation of accumulation or falling of merchandise or another anomalous situation, such as the recognition of the presence of a person in the area (b) which logically implies a fall or that an operator is in the area of passage of the merchandise to the truck, which entails a serious risk for physical integrity.

A very efficient access control system for controlling access to the loading bay (600) is thereby achieved as it allows characterizing the object, person or people generating the disturbance at a very low cost and without modifying current facilities. The described system allows, for example, operations ranging from controlling the bay (600) in a completely individualized manner, detecting the access of a single person, to the control and traceability of the merchandise, providing the loading management system with an improvement in making decisions in a quick and efficient manner compared to the known prior art, which enables a higher degree of automation in the facility.

Virtual Fence (700)

Figure 7:
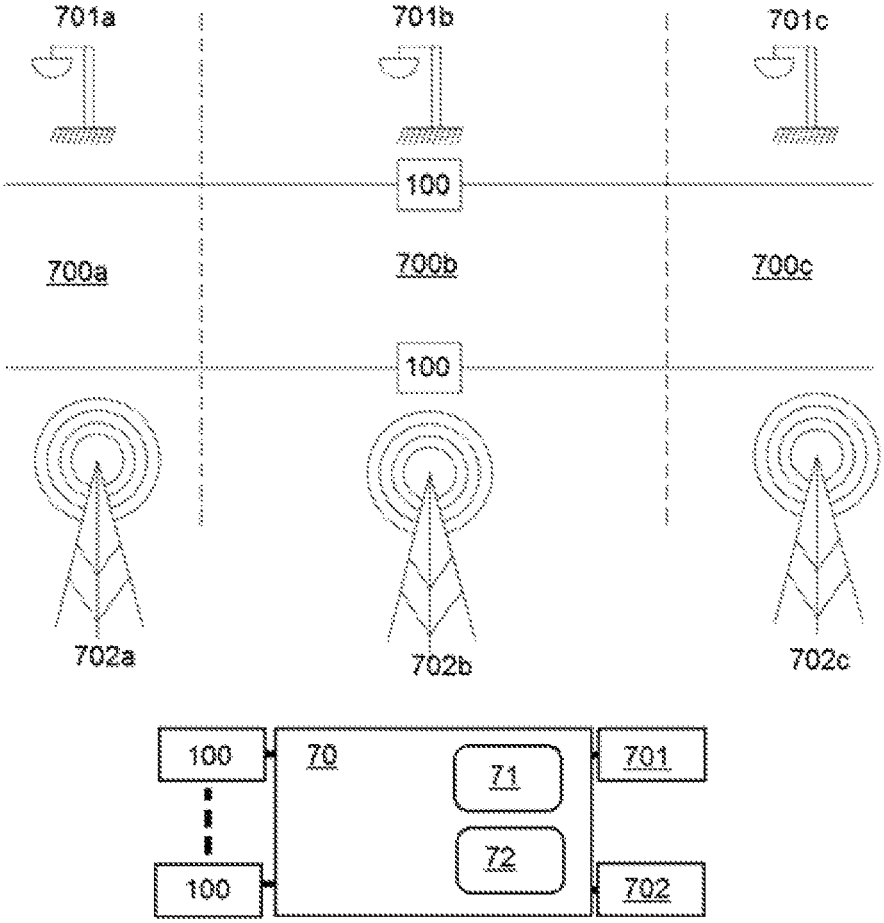
FIG. 7 shows a schematic of the system of the invention configured as a virtual fence.

In another particular embodiment shown in FIG. 7, the access control system for controlling access to a restricted area is configured as a virtual fence (700) and is particularly useful in the control of security areas with different degrees of access that are typical for sensitive facilities and that are now solved with different recognition systems (biometric systems or systems for personal identification by means of cards) connected to a database and an authentication system. The system described below considerably simplifies this task.

As can be observed in FIG. 7, the virtual fence comprises two antennas (1), each of them being connected to its respective sensor (100) arranged longitudinally in a space in which three security areas (700*a*, 700*b*, 700*c*) are defined. Each security area comprises a camera (701*a*, 701*b*, 701*c*) and a wireless connection (702*a*, 702*b*, 702*c*) that can be a WIFI- or Bluetooth®-type connection or another equivalent connection for a person skilled in the art.

In another embodiment, a sensor (100) is connected to the two antennas (1). It is generally considered that the maximum length of an antenna (1) connected to a sensor is ten meters, without there being any restriction as to the number of sensors that can be used in parallel connected to one and the same control device (70).

The control device (70) comprises: one or more processors (71), a memory (72), and one or more programs; wherein the program or programs are stored in the memory (72) and configured for being run by means of at least the processor or processors (71); wherein the programs include instructions for: (i) characterizing a disturbance detected by at least one sensor (100); (ii) focusing at least one camera (701*a*, 701*b*, 701*c*) on the area of action of at least one sensor (100) with a detected disturbance; (iii) monitoring the area of action of a sensor (100) with a detected disturbance; (iv) generating a control signal and (v) communicating with an authentication and authorization system.

Therefore, a user in the first security area (700*a*) will be detected by the sensor (100) and their presence will be characterized by the control device (100) which will focus the camera (701*a*) of said area on the source of the disturbance. In this case, monitoring involves: (a) biometric recognition of the user by means of the camera; and/or (b) interrogation of a user identification device (for example, a mobile application of the person himself or herself, or a passive wireless signal emitter) through the wireless connection (702*a*, 702*b*, 702*c*). This monitoring results in a query with the authentication and authorization system. If the query provides a negative result because the person who caused the disturbance is not authorized, the control signal generated by the control device (100) can result in an alarm or even in the automatic blocking of the security area (700*a*).

There are infinite uses of virtual fences and they are not restricted to the use thereof for restricted security access control, but rather can be used, for example, for the control of dangerous animals in open-range zoos. Therefore, if the animal gets past or gets into a safety area critical for the safety of people or visitors, or even if the falling of a person into a pit of a zoo is detected, a tranquilizer that is placed on the animal's body (for example, in a collar with a microinjector) could be released to minimize risks for people.

With the aforementioned solution of the security fence (700), restricted area access control with different security levels is simplified, furthermore being done in a discrete manner (the antennas (1) can be hidden or concealed) and leaving complete freedom for the user because said user will not need to perform any action for authentication as is currently required, which entails a more versatile and easier use with respect to current systems.

Access to Safes (800)

Figure 8:
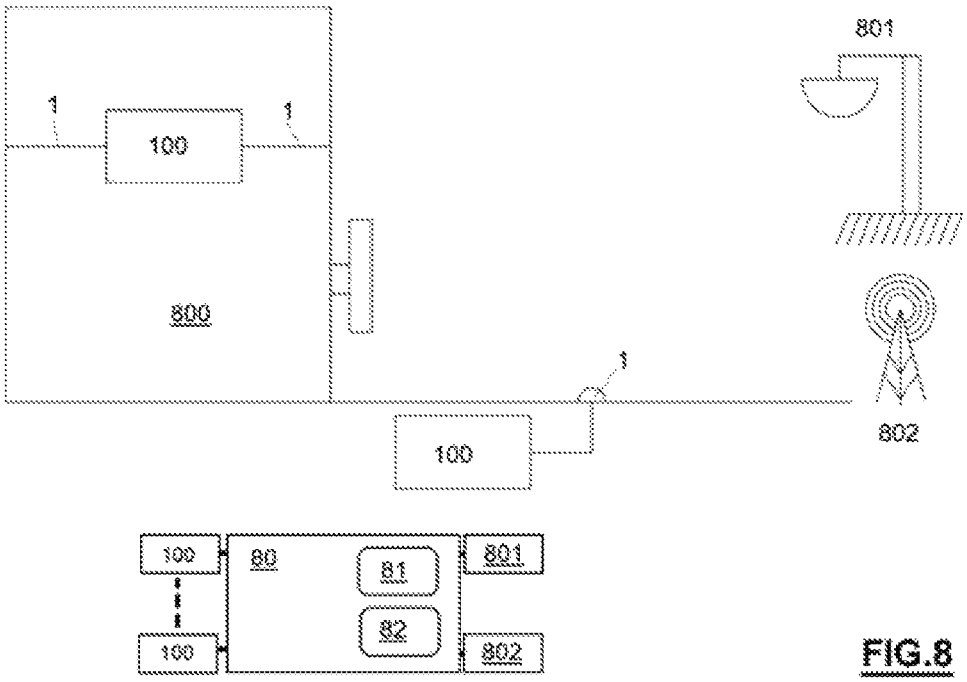
FIG. 8 shows a schematic of the system of the invention for safes.

Another particular embodiment shown in FIG. 8 illustrates access control system for controlling access to safes (800) in which the antenna (1) can have two basic positions:

a) Around or close to the safe (800) a distance (d) from said safe.

b) In the actual safe (800)

Position (a) allows controlling the access of people to the restricted area or area close to the safe, whereas position (b) allows detecting any contact with same. In this case, each antenna of each position will be connected to a different sensor (100) for greater detection and control certainty. The system will be completed with a camera (801) that can be aimed at both areas (a) or (b) and a wireless communication device (802) that can be a WIFI- or Bluetooth®-type device or another equivalent device for a person skilled in the art.

In any case, all the sensors (100) are connected to a control device (80) comprising: one or more processors (81), a memory (82), and one or more programs; wherein the program or programs are stored in the memory (82) and configured for being run by means of at least the processor or processors (81), the programs including instructions for: (i) characterizing a disturbance detected by at least one sensor (100); (ii) focusing at least one camera (801) on the area of action of at least one sensor (100) with a detected disturbance; (iii) monitoring the area of action of a sensor (100) with a detected disturbance; (iv) generating a control signal and (v) communicating with an authentication system.

Therefore, a user in the first security area (a) will be detected by the sensor (100) and their presence will be characterized by the control device (100) which will focus the camera (801) of said area on the source of the disturbance. In this case, monitoring involves: (a) biometric recognition of the user by means of the camera; and/or (b) interrogation of a user identification device (for example, a mobile application of the person himself or herself, or a passive wireless signal emitter) through the wireless means (802). This monitoring results in a query with the authentication system. If the query provides a negative result because the person who caused the disturbance is not authorized, the control signal generated by the control device (100) can result in an alarm or even in the automatic blocking of the safe (800). There is a two-fold increase in security in this case as there is a redundancy in identification and surveillance, because the person in area (a) will not have the same permission as in area (b), which is advantageous for security.

Safes today require, for example, special permits for cleaning them, granting access to the site and safes to people who, in theory, do not have to touch them, there being a minor security breach that must be solved which is done in a very efficient manner given that it allows characterizing the object, person or people generating the disturbance at a very low cost and without modifying current facilities.

Exhibiting Valuable Objects (900)

Figure 9:
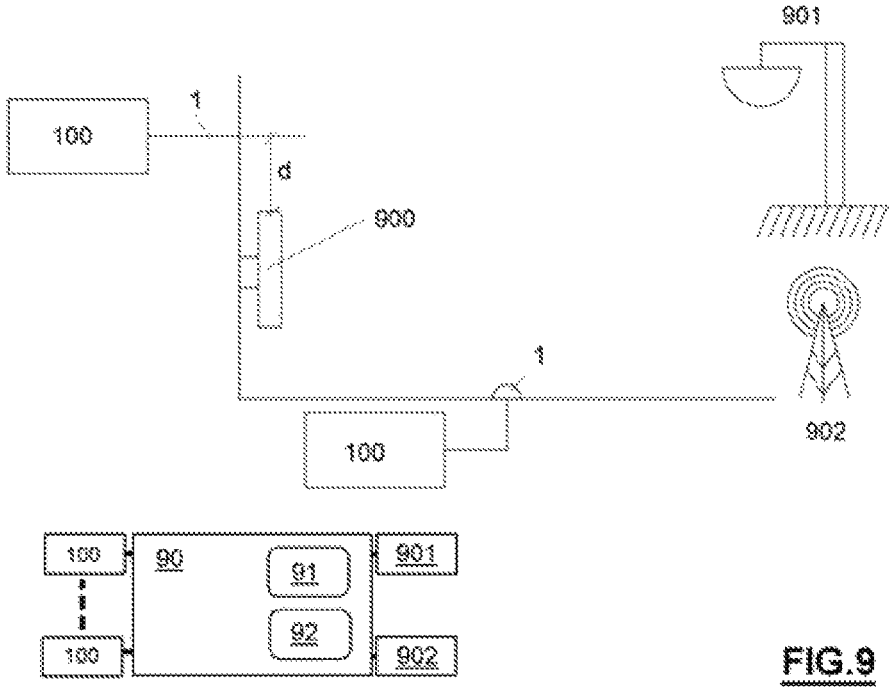
FIG. 9 shows a schematic of the system of the invention for exhibiting valuable objects.

Another particular embodiment shown in FIG. 9 illustrates the access control system for controlling access to valuable objects (900), for example in museums or exhibits, wherein the antenna (1) can have two basic positions:

a) Arranged a distance (d) from the valuable object (900)

b) Around the exhibit area of the valuable object (900)

Position (a) allows controlling the access of people to the restricted area or area close to same, whereas position (b) allows detecting any contact with the object. In this case, each antenna of each position will be connected to a different sensor (100) for greater detection and control certainty. The system will be completed with a camera (901) that can be aimed at both areas (a) or (b) and a wireless communication device (902) that can be a WIFI- or Bluetooth®-type device or another equivalent device for a person skilled in the art.

In any case, all the sensors (100) are connected to a control device (90) comprising: one or more processors (91), a memory (92), and one or more programs; wherein the program or programs are stored in the memory (92) and configured for being run by means of at least the processor or processors (91), the programs including instructions for: (i) characterizing a disturbance detected by at least one sensor (100); (ii) focusing at least one camera (91) on the area of action of at least one sensor (100) with a detected disturbance; (iii) monitoring the area of action of a sensor (100) with a detected disturbance (iv) generating a control signal and (v) communicating with an exhibit authentication and/or management system.

Therefore, a user in the first security area (a) will be detected by the sensor (100) and their presence will be characterized by the control device (100) which will focus the camera (901) of said area on the source of the disturbance. In this case, monitoring simply involves control of the people observing the object, for example, to establish a headcount or statistical analysis of the viewing of the object. However, in the second area (b) monitoring involves: (a) biometric recognition of the user by means of the camera; and/or (b) the interrogation of a user identification device (for example, a mobile application of the person himself or herself, or a passive wireless signal emitter). This monitoring results in a query with the authentication system. If the query provides a negative result because the person who caused the disturbance is not authorized, the control signal generated by the control device (90) can result in an alarm or even in the object (900) being locked up. There is a two-fold increase in security in this case as there is a redundancy in identification and surveillance, because area (a) and area (b) are classified as very different risk areas, which on one hand allows establishing statistical control over the viewing of the object (to subsequently assess its interest and allow better planning of the exhibits, for example) as well as providing a redundant security system for the object because the camera (901), for example, is able to detect the passage of a person between areas (a) and (b), which allows tracking the hypothetical threat for the object (900).

As a result of the described system, the control of access to valuable objects (900) on exhibit is achieved in a very efficient manner because it allows characterizing an object, animal, person or people generating the disturbance at a very low cost and without modifying current facilities.

Finally, it should be indicated that in all the preceding embodiments it is possible to monitor the signal of the respective cameras through a display. Likewise, it should be indicated that the control device (40, 50, 60, 70, 80, 90) can be a portable or non-portable computer system, without this detracting from or changing the function thereof. Furthermore, in all the embodiments the control device (40, 50, 60, 70, 80, 90) can be integrated in the sensor (100) itself or it can be an independent element.

The indicated embodiments are practical applications of one and the same invention, which is an access control system for use in restricted areas and industrial environments. Nevertheless, each of the embodiments shown has particularities in its operation derived precisely from the versatility and modularity of the system object of the invention.

The invention claimed is:

1. An access control system for use in restricted areas and industrial environments (400, 500, 600, 700, 800, 900) comprising at least:

one controlled electrostatic field sensor (100) connected to at least one antenna (1), wherein said antenna (1) is configured as a single electrode, such that said sensor (100) is arranged to measure the disturbances in the electrostatic field around said antenna (1) in a selected direction; and wherein the controlled electrostatic field sensor (100) is configured for detecting a disturbance in the electrostatic field generated by its own antenna (1);

wherein at least one antenna (1) is in position close to the restricted area and industrial environment (400, 500, 600, 700, 800, 900); and wherein the antenna (1) is shielded to direct the electrostatic field generated around it to a desired point of interest; wherein each sensor (100) is arranged to continuously measure the fluctuations in the electrostatic field caused by the influence of a body close to the antenna (1); and wherein each sensor (100) is further arranged to shape the electromagnetic and electrostatic field generated in the antenna (1) by taking a capacity measurement continuously;

wherein each sensor (100) is further connected to a control device (40, 50, 60, 70, 80, 90) comprising: one or more processors (41, 51, 61, 71, 81, 91), a memory (42, 52, 62, 72, 82, 92), and one or more programs; wherein the program or programs are stored in the memory (42, 52, 62, 72, 82, 92) and configured for being run by means of at least the processor or processors (41, 51, 61, 71, 81, 91), the programs including instructions for:

characterizing a disturbance detected by at least one sensor (100) through the changes in magnitude of the electrostatic field, further including:

distinguishing different types of bodies or objects; and discriminating human presence from another material or animal presence;

focusing at least one camera (403, 504, 603, 701*a*, 701*b*, 701*c*, 801, 901) on the area of action of at least one sensor (100) with a detected disturbance;

monitoring the area of action of a sensor (100) with a detected disturbance;

generating a control signal; and communicating with a central control unit (10).

2. The system according to claim 1 for controlling access to a railway platform (400), comprising at least one antenna (1) arranged longitudinally a distance (d) from the edge (401) of the platform (400) or in a position immediately below the edge (401) of the platform (400), or in both positions.

3. The system according to claim 2, comprising a plurality of sensors (100) arranged in the platform (400) at a maximum length of ten meters from one another.

4. The system according to claim 1, comprising at least one antenna (1) arranged longitudinally a distance (d) from the edge (601) of the loading bay (600) or in a position immediately below the edge (601) of the loading bay (600), or in both.

5. The system according to claim 4, wherein merchandise (602) can each have its own sensor (100) with its own antenna (1) connected to the control device (60).

6. The system according to claim 1 configured for controlling access to a maritime dock (500) wherein the, at least, one antenna (1) is arranged in a longitudinal position along the edge (501) of the maritime dock (500); and in a position close to the area of activity of a loading crane (502).

7. The system according to claim 6, wherein the containers (503) used in a port comprise their own sensor (100) with its own antenna (1) and wireless communication means for wirelessly communicating with the control device (50).

8. The system according to claim 6, wherein the antenna (1) has a maximum length of ten meters.

9. The system of claim 1 used as a virtual fence (700) comprising two antennas (1) each of which is arranged longitudinally in a space wherein a plurality of security areas (700*a*, 700*b*, 700*c*) are defined; and wherein each security areas comprises a camera (701*a*, 701*b*, 701*c*).

10. The system according to claim 9, wherein the maximum length between each antenna (1) is ten meters.

11. The system of claim 1 for controlling access to safes (800) comprising, at least, one antenna (1) arranged in a position:

(a) a distance (d) around or close to the safe (800);

(b) in the actual safe (800); and comprising a camera (801) that can be aimed at the coverage area of the, at least, one antenna (1) and a wireless communication device (802).

12. The system according to claim 11, wherein each antenna (1) is connected to a sensor (100).

13. The system of claim 1 for controlling access to valuable objects (900) on exhibit comprising at least one antenna (1) which is:

(a) arranged in a distance (d) from the valuable object (900);

(b) arranged around the exhibit area of the valuable object (900); and further comprising a camera (901) that can be aimed at the coverage area of the, at least, one antenna (1) and a wireless communication device (902).

14. An access control method for use in restricted areas and industrial environments (400, 500, 600, 700, 800, 900) which is implemented in the system according to any of claims 1-3, 7, 8, 4, 5, 10, 12 and 6, 9, 11, 13 comprising:

providing one controlled electrostatic field sensor (100) connected to at least one antenna (1), wherein said antenna (1) is configured as a single electrode;

generating an electrostatic field around the antenna (1) in a selected direction; and measuring the disturbances in the electrostatic field around said antenna (1) with the controlled electrostatic field sensor (100);

positioning the, at least, one antenna (1) close to the restricted area and industrial environment (400, 500, 600, 700, 800, 900); and wherein the antenna (1) is shielded to direct the electrostatic field generated around it to a desired point of interest;

measuring the fluctuations in the electrostatic field generated caused by the influence of a body close to the antenna (1); and shaping the electromagnetic and electrostatic field generated in the antenna (1) by taking a capacity measurement continuously;

characterizing the disturbance detected by at least one sensor (100) through the changes in magnitude of the electrostatic field, further including:

distinguishing different types of bodies or objects; and discriminating human presence from another material or animal presence;

focusing at least one camera (403, 504, 603, 701*a*, 701*b*, 701*c*, 801, 901) on the area of action of at least one sensor (100) with a detected disturbance;

monitoring the area of action of a sensor (100) with a detected disturbance;

generating a control signal; and communicating with a central control unit (10).

15. The method of claim 14 wherein for use in, at least: (i) controlling access to a railway platform (400); or (ii) controlling access to a maritime dock (500); or (iii) controlling access to a merchandise loading bay (600); or (iv) virtual fences (700); (v) controlling access to safes (800); or (vi) access to valuable objects (900) on exhibit.

* * * * *